US012662718B2

(12) United States Patent
Ayadi et al.

(10) Patent No.: US 12,662,718 B2
(45) Date of Patent: Jun. 23, 2026

(54) PROCESS OF EXTRACTION OF LITHIUM FROM A MATERIAL COMPRISING LITHIUM AND AT LEAST ANOTHER METAL

(71) Applicants: UNIVERSITE DE ROUEN-NORMANDIE, Montsaint-Aignan (FR); INSTITUT NATIONAL DES SCIENCES APPLIQUÉES DE ROUEN, Saint-Etienne du Rouvray (FR); CENTRE NATIONAL DE LA RECHERCHE SCIENTIFIQUE, Paris (FR); ECOLE NATIONALE SUPERIEURE D'INGENIEURS DE CAEN, Caen (FR); UNIVERSITE DE CAEN NORMANDIE, Caen (FR)

(72) Inventors: Firas Ayadi, Rouen (FR); Virginie Nachbaur, Terres de Bord (FR); Valérie Pralong, Caen (FR)

(73) Assignees: UNIVERSITE DE ROUEN-NORMANDIE, Mont-Saint-Aignan (FR); INSTITUT NATIONAL DES SCIENCES APPLIQUÉES DE ROUEN, Saint-Etienne du Rouvray (FR); CENTRE NATIONAL DE LA RECHERCHE SCIENTIFIQUE, Paris (FR); ECOLE NATIONALE SUPERIEURE D'INGENIEURS DE CAEN, Caen (FR); UNIVERSITE DE CAEN NORMANDIE, Caen (FR)

( * ) Notice: Subject to any disclaimer, the term of this patent is extended or adjusted under 35 U.S.C. 154(b) by 933 days.

(21) Appl. No.: 17/759,128

(22) PCT Filed: Jan. 19, 2021

(86) PCT No.: PCT/EP2021/051065
§ 371 (c)(1),
(2) Date: Jul. 20, 2022

(87) PCT Pub. No.: WO2021/148403
PCT Pub. Date: Jul. 29, 2021

(65) Prior Publication Data

US 2023/0056619 A1 Feb. 23, 2023

(30) Foreign Application Priority Data

Jan. 23, 2020 (EP) ..... 20305053

(51) Int. Cl.
*C22B 26/12* (2006.01)
*C22B 3/16* (2006.01)

(52) U.S. Cl.
CPC ..... *C22B 26/12* (2013.01); *C22B 3/16* (2013.01)

(58) Field of Classification Search
CPC ..... C22B 26/12; C22B 3/16; C22B 7/006; Y02P 10/20; Y02W 30/84
See application file for complete search history.

(56) References Cited

U.S. PATENT DOCUMENTS

| | | | |
|---|---|---|---|
| 9,073,760 B2 | 7/2015 | Matsuda et al. | |
| 2004/0028585 A1 | 2/2004 | Cardarelli et al. | |

FOREIGN PATENT DOCUMENTS

| | | | | |
|---|---|---|---|---|
| CN | 107628594 A | | 1/2018 | |
| CN | 109371227 A | | 2/2019 | |
| CN | 109666799 A | * | 4/2019 | ..... C22B 47/00 |
| WO | 2019204707 A1 | | 10/2019 | |

OTHER PUBLICATIONS

Machine translation of CN 109666799 A (Year: 2019).*
Tadesse Boga Le et al: 11 The benefi ciation of lithium minerals from hard rock ores: A review, Minerals Engineering, vol. 131, pp. 170-184, Nov. 19, 2018.

* cited by examiner

*Primary Examiner* — Keling Zhang
(74) *Attorney, Agent, or Firm* — FISHERBROYLES, LLP; Roger L. Browdy

(57) ABSTRACT

Lithium is extracted from a material comprising lithium and at least another metal, such as a transition or post-transition metal, by a process using a polyol solvent and a carbonate and a solvothermal treatment. A liquid containing lithium carbonate can be separated. Solid lithium carbonate can be isolated from the liquid containing lithium carbonate.

17 Claims, No Drawings

PROCESS OF EXTRACTION OF LITHIUM FROM A MATERIAL COMPRISING LITHIUM AND AT LEAST ANOTHER METAL

The present invention is in the field of the extraction of lithium from a material comprising lithium and at least another metal. In particular, the invention concerns a process of extraction of lithium at least, from a material comprising lithium and at least another metal.

Lithium and its compounds have several industrial applications, including heat-resistant glass and ceramics, lithium grease lubricants, flux additives for iron, steel and aluminum production, lithium batteries and lithium-ion batteries, especially for the automotive industry for the last two applications. These uses consume more than three quarters of lithium production.

Lithium-ion batteries are currently undergoing significant development due to their energy potential, manufacturing process and low cost. These batteries are used in electronic equipment, but also in most cases are the batteries used in electric vehicles.

In particular, the electric vehicles could represent between 35% and 50% of all the vehicles sales in 2040 and as a result, the evolution of lithium consumption follows the same trends as the electric vehicle penetration. The total demand for lithium by 2050 is therefore estimated at about 14 million tons a year according to a recent study by ADEME and IFPen.

Lithium salts may be extracted from water in mineral springs, brine pools, and brine deposits. Today, brine excavation is probably the most widely used lithium extraction technology. However, at least two problems with lithium brine production are emerging: reliability and geography. Indeed, weather has clear impacts on the production at lithium brine operations and with global demand for lithium on the rise, more reliable and consistent methods of production will be required. But lithium brine operations are limited to selected climates and regions that can support sufficient weather to ensure economic processing.

Hard rock lithium deposits may fill the demand as they are more evenly geographically distributed across the globe and are less dependent on a changing climate for production.

Although lithium occurs in a wide variety of minerals and ores, there are only a relatively few ores that are sufficiently available and contain a sufficient amount of lithium to make them attractive as a commercially practicable source of lithium. Among these commercially practicable sources of lithium, spodumene is the mineral that attracts the most interest and various processes for recovering the lithium values from spodumene ore have been proposed. Only two processes seem to have been practiced industrially: sintering method and sulfuric acid process, and sulfuric acid process has become the main method for production of lithium carbonate from spodumene due to its high efficiency. However, this process has its intrinsic drawbacks, such as high levels of sulfate and heavy metal ions in the product, sophisticated process for recovering sodium sulfate, etc.

Other processes involve a leaching step with carbon dioxide, in addition to an autoclave-based step. The need of an additional step and the management of the gaseous $CO_2$ make these processes expensive in economic and environmental terms.

In addition to that, valuation of wastes of electrical and electronic equipment (WEEE) also referred to as "urban mine" is a booming thematic and represents an important potential source of lithium.

Indeed, in this context of growing demand for lithium, a policy of managing the materials to be recycled can provide a country that does not have access to raw materials (or does not exploit them directly) with the resources necessary for its growth.

In addition, the European Union has begun to take this issue into account, as evidenced by the many directives adopted on the recycling of WEEE, on eco-design and its action plan for the circular economy. In the specific case of batteries, this recycling is governed by Directive 2006/66/EC of the European Parliament and of the Council of 6 Sep. 2006 on batteries and accumulators and waste batteries and accumulators, which stipulates in Article 13 that "Member States shall encourage the development of new recycling and treatment technologies, and promote research into environmentally friendly and cost-effective recycling methods for all types of batteries and accumulators".

Several recycling processes for lithium-ion batteries exist, most of them based on hydrometallurgy or pyrometallurgy. The hydrometallurgy processes use strong acid baths and are very solvent-intensive, which generates high economic and environmental costs. In addition, the use of strong acids for leaching results in the non-selective dissolution of all active electrode components (i.e. lithium and also other metals such as Co, Ni, Mn, etc.). This implies the need for several additional extraction and/or precipitation steps.

The pyrometallurgy requires high heating (700 to 1000° C. or even higher) of the compounds to extract them, which requires a lot of energy, again with high economic and environmental costs.

Some processes use deep eutectic solvents for cathode recycling of Li-ion batteries. But again, these processes involve a complete dissolution of the elements present in the cathode materials, for example Co, Ni, and/or Mn in addition of Li. It is therefore necessary to carry out selective precipitation treatments to isolate Li from the other metals.

Other processes involve the heating in water, in the presence of an oxidizing agent such as hydrogen peroxide and carbon dioxide, or the use of a volatile organic solvent and an acid. However, the need of extra steps, the management of the gaseous $CO_2$ or the organic solvent and the handling and subsequent treatment of the oxidant or the acid make these processes expensive in economic and environmental terms.

Accordingly, it is an object of the present invention to provide a process of extraction of lithium that does not require the use of hazardous chemicals and/or chemical that require waste post-treatment, but also an economically viable process, in particular one that uses little energy and is environmentally friendly.

A further goal of the present invention is to provide, in the case of the extraction of a lithium source containing other metals, a process in which lithium is easily separated from these other metals.

Thus, in one aspect, the present invention relates to a process of extraction of lithium at least, from a material comprising lithium and at least another metal, said process comprising the following steps:

a) Contacting said material with a polyol solvent and a carbonate to obtain a reaction mixture;
b) Performing a solvothermal treatment of the reaction mixture obtained in step a) to obtain a solvothermally treated composition SP1;
c) Separating the liquid L1 containing lithium carbonate and the solid S1 forming the composition SP1 obtained in step b);

d) Optionally, isolating solid lithium carbonate from the liquid L1.

The present invention also relates to a process of extraction of lithium at least, from a material comprising lithium and at least another metal, said process comprising the following steps:

a) Contacting said material with a polyol solvent and a carbonate to obtain a reaction mixture;
b) Performing a solvothermal treatment of the reaction mixture obtained in step a) to obtain a solvothermally treated composition SP1;
c) Separating the liquid L1 containing lithium carbonate and the solid S1 forming the composition SP1 obtained in step b);
d) Optionally, isolating solid lithium carbonate from the liquid L1;
e) Contacting the solid S1 with water to obtain a composition SP2;
f) Separating the liquid L2 containing lithium carbonate and the solid S2 forming the composition SP2 obtained in step e);
g) Optionally, isolating solid lithium carbonate from the liquid L2.

In a particular embodiment, the solid S2 contains the at least another metal.

In a particular embodiment, the at least another metal is chosen from transition metals and post-transition metals, in particular from Co, Ni, Mn, Fe, Ti and Al, in particular from Co, Ni, Mn and Al.

In a particular embodiment, the material comprises or is a lithium-ion battery cathode material, in particular chosen from:

lithium and cobalt containing lithium-ion battery cathode material, in particular $LiCoO_2$;
lithium and manganese containing lithium-ion battery cathode material, in particular $LiMn_2O_4$;
lithium, nickel, manganese and cobalt containing lithium-ion battery cathode material, in particular $LiNi_{0.33}Mn_{0.33}Co_{0.33}O_2$;
lithium, nickel, cobalt and aluminum containing lithium-ion battery cathode material, in particular $LiNi_{0.8}Co_{0.15}Al_{0.05}O_2$;
lithium and titanium containing lithium-ion battery cathode material, in particular $Li_4Ti_5O_{12}$;
lithium and iron containing lithium-ion battery cathode material, in particular $Li_3Fe_2(PO_4)_3$;
the mixtures of at least two of the materials listed above.

In a particular embodiment, the material comprises or is a lithium-ion battery cathode material, in particular chosen from:

lithium and cobalt containing lithium-ion battery cathode material, in particular $LiCoO_2$;
lithium and manganese containing lithium-ion battery cathode material, in particular $LiMn_2O_4$;
lithium, nickel, manganese and cobalt containing lithium-ion battery cathode material, in particular $LiNi_{0.33}Mn_{0.33}Co_{0.33}O_2$;
lithium, nickel, cobalt and aluminum containing lithium-ion battery cathode material, in particular $LiNi_{0.8}Co_{0.15}Al_{0.05}O_2$; and
the mixtures of at least two of the materials listed above.

In a more particular embodiment, the lithium-ion battery cathode material is a mixture of two, three, four or more of the above-defined materials. For example, the material may be a mixture constituted of or containing $LiCoO_2$; $LiMn_2O_4$; $LiNi_{0.33}Mn_{0.33}Co_{0.33}O_2$ and $LiNi_{0.8}Co_{0.15}Al_{0.05}O_2$.

In a particular embodiment, the material is a material containing a lithium-ion battery cathode material as defined above.

In a particular embodiment, the material is a lithium-ion battery cathode material as defined above.

The material may also be a lithium-ion battery cathode.

The lithium-ion battery cathode material is for example an used cathode, production scrap or non-compliant material. The lithium-ion battery cathode material can notably be a crushed used cathode, a lithium containing composition of an used cathode, or an aluminum foil coated with a lithium composition as found in used lithium-ion battery cathodes.

The material may also be a lithium-ion battery. In particular, the lithium-ion battery anode material does not interfere with the process of the invention.

The lithium-ion battery is for example an used battery, production scrap or non-compliant material. The lithium-ion battery can notably be a crushed used battery, or a lithium containing composition of an used battery.

In a particular embodiment, the material is a lithium ore, in particular spodumene (more particularly $LiAlSi_2O_6$), petalite (more particularly $LiAlSi_4O_{10}$), lepidolite (more particularly $K(Li,Al)_3(Si,Al)_4O_{10}(F,OH)_2$), eucryptite (more particularly $LiAlSiO_4$), amblygonite (more particularly $(Li,Na)AlPO_4(F,OH)$), or a mixture thereof.

When the lithium ore material is spodumene, said spodumene is preferably calcinated prior to step a). This calcination is well known from those skilled in the art, and enables the conversion of alpha-spodumene into beta-spodumene In a particular embodiment, the material is in powder form. More particularly, the material is in the form of a composition comprising a plurality of particles having a size ranging from 1 to 1000 μm, notably from 1 to 100 μm.

When the material is a lithium-ion battery cathode material, said material is usually already in powder form within the lithium-ion battery cathode.

When the material is a lithium ore, it may be powdered in a powder form as defined above prior to step a).

In a particular embodiment, the polyol solvent is chosen from the group comprising ethylene glycol, diethylene glycol, triethylene glycol, tetraethylene glycol, propylene diol, liquid polyethylene glycols, such as polyethylene glycol 200 to 600, butylene glycol, in particular 1,3-butylene glycol and 1,4-butylene glycol, hexylene glycol and glycerol.

In a particular embodiment, the polyol solvent is anhydrous. By anhydrous is notably meant that the polyol solvent contains 5% or less, in particular 4% or less, 3% or less, 2% or less, 1% or less, 0.5% or less, 0.4% or less, 0.3% or less, 0.2% or less, or 0.1% or less, in weight of water, more particularly 1% or less than 1% in weight of water.

In a particular embodiment, the carbonate is at least one metal carbonate, in particular at least one alkali metal carbonate, more particularly sodium carbonate, potassium carbonate or their mixtures.

In a more particular embodiment, the carbonate is sodium carbonate and/or potassium carbonate, even more particularly sodium carbonate or potassium carbonate.

In a particular embodiment, the mass concentration of said material in the polyol solvent ranges from 1 to 100 g/L, in particular from 5 to 50 g/L, more particularly from 10 to 20 g/L, for example of about 16 g/L.

In a particular embodiment, the weight ratio of said material over said carbonate ranges from 0.1 to 10, in particular from 0.2 to 5. In a particular embodiment, said process is performed in the absence of an acid, in particular a strong acid, for example hydrochloric acid, nitric acid or sulfuric acid, of carbon dioxide, of an oxidant, in particular hydrogen peroxide, ozone, persulfate salts, and of volatile organic solvents, for example acetone, acetonitrile, benzene, 1-butanol, acetic acid, chloroform, t-butanol, cyclohexane, carbon tetrachloride, ethyl acetate, dimethyl sulfoxide, dichloromethane, ethanol, diethyl ether, isopropyl acetate, heptane, dichloroethane, 2-propanol, isooctane, di-isopropyl ether, 1-propanol, methylcyclohexane, dimethylformamide, ethyl acetate, 2-methylTHF, dioxane, methyl t-butyl ether, dimethyl acetate, methanol, toluene, dimethoxyethane, methyl ethyl ketone, tetrahydrofuran, hexane(s), xylenes, N-methylpyrrolidinone, pentane, and pyridine.

Contacting step a) can be performed according to any techniques well known from the one skilled in the art, in particular by mechanical, magnetic or manual stirring and/or by ultrasound treatment.

In a particular embodiment, the polyol solvent corresponds to a liquid L1 of the step a) of a previous extraction according to the present invention. This embodiment corresponds to a recycling of the polyol solvent used in the framework of the present invention. This recycling may be performed two, three, four times or more. In this case, the polyol solvent in particular corresponds to a liquid L1 of the step a) of a $n^{th}$ extraction according to the present invention with a polyol solvent, said polyol solvent being notably obtained from a $(n-1)^{th}$ extraction with a polyol solvent, this latter being for example a liquid L1 of the step a) of a $(n-2)^{th}$ extraction, and so on.

The solvothermal treatment of step b) can be performed according to any techniques well known from the one skilled in the art, in particular by using an autoclave, more particularly a stainless steel autoclave.

The configuration of said autoclave can be a batch, semi-batch or continuous configuration. Such configurations are well known from the one skilled in the art.

In a particular embodiment, the solvothermal treatment of step b) is performed at a temperature over the boiling point of the polyol solvent and under 500° C.

In a particular embodiment, the solvothermal treatment of step b) is performed at a temperature from 200 to 500° C., in particular from 220 to 500° C., more particularly from 220 to 400° C., for example at about 225° C.

In a particular embodiment, the solvothermal treatment of step b) is performed at a pressure above atmospheric pressure, for example 1.013 bar, and equal to or less than 5000 bar, in particular at a pressure ranging from 10 to 500 bar, more particularly at about 125 bar.

In a particular embodiment, the solvothermal treatment of step b) is performed for 1 hour to 1 week, in particular from 2 hours to 5 days, more particularly from 4 to 80 hours, notably when said autoclave is in batch configuration.

In a particular embodiment, the solvothermal treatment of step b) is performed for 0.25 hour to 24 hours, in particular from 0.5 hour to 10 hours, notably when said autoclave is in continuous configuration.

Separating step c) can be performed according to any techniques well known from the one skilled in the art, in particular by centrifugation, filtration and/or decantation, more particularly by centrifugation.

Step d) can be performed according to any techniques well known from the one skilled in the art, in particular by evaporation of the polyol solvent, more particularly under reduced pressure.

In an advantageous embodiment, the solid S1 obtained in step c) is prior to step e) washed with a solvent in which lithium carbonate is not soluble. This solvent is in particular chosen from alcohol solvents, for example ethanol or propanol, and ketone solvents, for example acetone. For example, this washing can be performed by contacting solid S1 with ethanol under ultrasounds, washed solid S1 being then separated from the liquid, notably by centrifugation.

Contacting step e) can be performed according to any techniques well known from the one skilled in the art, in particular by mechanical, magnetic or manual stirring and/or by ultrasound treatment.

Separating step f) can be performed according to any techniques well known from the one skilled in the art, in particular by centrifugation, filtration and/or decantation, more particularly by centrifugation.

In a particular embodiment, and when the at least another metal is at least a magnetic metal, or at least a magnetic metal and at least a non magnetic metal, the separating step f) may comprise a magnetic separating sub-step f1), to isolate the at least a magnetic metal from the composition SP1, followed by a separating sub-step f2) corresponding to the separating step f) as defined above, to obtain the liquid L2 and a solid S2 containing in particular the at least a non magnetic metal.

Step g) can be performed according to any techniques well known from the one skilled in the art, in particular by evaporation of the water, more particularly under reduced pressure.

The solid S2 can be further dried and/or calcinated according to any techniques well known from the one skilled in the art.

In a more particular embodiment, the present invention concerns the process of extraction of lithium and cobalt from a material consisting of or comprising lithium and cobalt containing lithium-ion battery cathode material, in particular $LiCoO_2$, said process comprising the following steps:

a) Contacting said material with a polyol solvent and a carbonate to obtain a reaction mixture;
b) Performing a solvothermal treatment of the reaction mixture obtained in step a) to obtain a solvothermally treated composition SP1;
c) Separating the liquid L1 containing lithium carbonate and the solid S1 forming the composition SP1 obtained in step b);
d) Optionally, isolating solid lithium carbonate from the liquid L1;
e) Contacting the solid S1 with water to obtain a composition SP2;
f) Separating the liquid L2 containing lithium carbonate and the solid S2 containing cobalt forming the composition SP2 obtained in step e);
g) Optionally, isolating solid lithium carbonate from the liquid L2.

In a more particular embodiment, the present invention concerns the process of extraction of lithium and cobalt from a material consisting of or comprising lithium, nickel, manganese and cobalt containing lithium-ion battery cathode material, in particular $LiNi_{0.33}Mn_{0.33}Co_{0.33}O_2$, said process comprising the following steps:

a) Contacting said material with a polyol solvent and a carbonate to obtain a reaction mixture;
b) Performing a solvothermal treatment of the reaction mixture obtained in step a) to obtain a solvothermally treated composition SP1;
c) Separating the liquid L1 containing lithium carbonate and the solid S1 forming the composition SP1 obtained in step b);
d) Optionally, isolating solid lithium carbonate from the liquid L1;

e) Contacting the solid S1 with water to obtain a composition SP2;

f1) magnetic separating of the composition SP2 to isolate a solid containing cobalt and nickel from the composition;

f2) Separating the liquid L2 containing lithium carbonate and the solid S2 containing manganese, in particular in $MnCO_3$ form, forming the composition obtained at the end of step f1);

g) Optionally, isolating solid lithium carbonate from the liquid L2.

In a more particular embodiment, the present invention concerns the process of extraction of lithium and manganese containing lithium-ion battery cathode material, in particular $LiMn_2O_4$, said process comprising the following steps:

a) Contacting said material with a polyol solvent and a carbonate to obtain a reaction mixture;

b) Performing a solvothermal treatment of the reaction mixture obtained in step a) to obtain a solvothermally treated composition SP1;

c) Separating the liquid L1 containing lithium carbonate and the solid S1 forming the composition SP1 obtained in step b);

d) Optionally, isolating solid lithium carbonate from the liquid L1;

e) Contacting the solid S1 with water to obtain a composition SP2;

f) Separating the liquid L2 containing lithium carbonate and the solid S2 containing manganese, in particular in $MnCO_3$ and/or $Mn_3O_4$ form, forming the composition SP2 obtained in step e);

g) Optionally, isolating solid lithium carbonate from the liquid L2;

h) Optionally, calcinating the solid S2 to obtain a solid S3 containing manganese, in particular in $Mn_2O_3$ form.

In a more particular embodiment, the present invention concerns the process of extraction of lithium, nickel, cobalt and aluminum containing lithium-ion battery cathode material, in particular $LiNi_{0.8}Co_{0.15}Al_{0.05}O_2$, said process comprising the following steps:

a) Contacting said material with a polyol solvent and a carbonate to obtain a reaction mixture;

b) Performing a solvothermal treatment of the reaction mixture obtained in step a) to obtain a solvothermally treated composition SP1;

c) Separating the liquid L1 containing lithium carbonate and the solid S1 forming the composition SP1 obtained in step b);

d) Optionally, isolating solid lithium carbonate from the liquid L1;

e) Contacting the solid S1 with water to obtain a composition SP2;

f1) magnetic separating of the composition SP2 to isolate a solid containing cobalt and nickel from the composition;

f2) Separating the liquid L2 containing lithium carbonate and the solid S2 containing aluminium, in particular in CoAlO and/or form, forming the composition obtained at the end of step f1);

g) Optionally, isolating solid lithium carbonate from the liquid L2.

In another aspect, the present invention concerns a process of lithium-ion battery cathode recycling comprising the steps as defined above, preceded by a step of recovery of a lithium-ion battery cathode material from a lithium-ion battery cathode or a lithium-ion battery, said steps being optionally followed by a step of use of at least one of the above-mentioned metals in a new process or device.

In another aspect, the present invention concerns a composition comprising:

a material chosen from lithium-ion battery cathode materials and lithium ores;

a carbonate; and a polyol solvent.

In particular, the composition is a composition for a solvothermal treatment.

It is noted that all the embodiments described above in relation with the processes apply here as well.

In a particular embodiment, the material is a lithium ore or a lithium-ion battery cathode material chosen from:

lithium and cobalt containing lithium-ion battery cathode material, in particular $LiCoO_2$;

lithium and manganese containing lithium-ion battery cathode material, in particular $LiMn_2O_4$;

lithium, nickel, manganese and cobalt containing lithium-ion battery cathode material, in particular $LiNi_{0.33}Mn_{0.33}Co_{0.33}O_2$;

lithium, nickel, cobalt and aluminum containing lithium-ion battery cathode material, in particular $LiNi_{0.8}Co_{0.15}Al_{0.05}O_2$;

lithium and titanium containing lithium-ion battery cathode material, in particular $Li_4Ti_5O_{12}$;

optionally, $Li_3Fe_2(PO_4)_3$; and the mixtures of at least two of the materials listed above.

In a particular embodiment, the material is a lithium ore or a lithium-ion battery cathode material chosen from:

lithium and cobalt containing lithium-ion battery cathode material, in particular $LiCoO_2$;

lithium and manganese containing lithium-ion battery cathode material, in particular $LiMn_2O_4$;

lithium, nickel, manganese and cobalt containing lithium-ion battery cathode material, in particular $LiNi_{0.33}Mn_{0.33}Co_{0.33}O_2$;

lithium, nickel, cobalt and aluminum containing lithium-ion battery cathode material, in particular $LiNi_{0.8}Co_{0.15}Al_{0.05}O_2$; and the mixtures of at least two of the materials listed above.

In another aspect, the present invention concerns a composition SP1 obtainable by the process as defined above, the material being in particular chosen from lithium-ion battery cathode materials and lithium ores.

In a particular embodiment, the material is a lithium ore or a lithium-ion battery cathode material chosen from:

lithium and cobalt containing lithium-ion battery cathode material, in particular $LiCoO_2$;

lithium and manganese containing lithium-ion battery cathode material, in particular $LiMn_2O_4$;

lithium, nickel, manganese and cobalt containing lithium-ion battery cathode material, in particular $LiNi_{0.33}Mn_{0.33}Co_{0.33}O_2$;

lithium, nickel, cobalt and aluminum containing lithium-ion battery cathode material, in particular $LiNi_{0.8}Co_{0.15}Al_{0.05}O_2$;

lithium and titanium containing lithium-ion battery cathode material, in particular $Li_4Ti_5O_{12}$;

optionally, $Li_3Fe_2(PO_4)_3$; and the mixtures of at least two of the materials listed above.

In a particular embodiment, the material is a lithium ore or a lithium-ion battery cathode material chosen from:

lithium and cobalt containing lithium-ion battery cathode material, in particular $LiCoO_2$;

lithium and manganese containing lithium-ion battery cathode material, in particular $LiMn_2O_4$;

lithium, nickel, manganese and cobalt containing lithium-ion battery cathode material, in particular $LiNi_{0.33}Mn_{0.33}Co_{0.33}O_2$;

lithium, nickel, cobalt and aluminum containing lithium-ion battery cathode material, in particular $LiNi_{0.8}Co_{0.15}Al_{0.05}O_2$; and the mixtures of at least two of the materials listed above.

In another aspect, the present invention concerns a composition comprising a polyol solvent, in particular ethylene glycol, and a solid composition, said polyol solvent comprising lithium and said solid composition comprising lithium carbonate and cobalt, in particular cobalt alpha and/or cobalt beta.

In another aspect, the present invention concerns a composition comprising a polyol solvent, in particular ethylene glycol, and a solid composition, said polyol solvent comprising lithium and said solid composition comprising lithium carbonate, nickel and cobalt, in particular in the form of a Ni—Co alloy, and manganese carbonate.

In another aspect, the present invention concerns a composition comprising a polyol solvent, in particular ethylene glycol, and a solid composition, said polyol solvent comprising lithium and said solid composition comprising lithium carbonate, manganese carbonate, and manganese oxide, in particular $Mn_3O_4$. It is noted that all the embodiments described above in relation with the processes apply here as well.

Definitions

The following terms and expressions contained herein are defined as follows:

As used herein, a range of values in the form "x-y" or "x to y", or "x through y", include integers x, y, and the integers therebetween. For example, the phrases "1-6", or "1 to 6" or "1 through 6" are intended to include the integers 1, 2, 3, 4, 5, and 6. Preferred embodiments include each individual integer in the range, as well as any subcombination of integers. For example, preferred integers for "1-6" can include 1, 2, 3, 4, 5, 6, 1-2, 1-3, 1-4, 1-5, 2-3, 2-4, 2-5, 2-6, etc.

As used herein, the term "about" refers in particular to a range of values within ±10% of a specific value. For example, the term "about 100" includes values of 100±10%, i.e. values from 90 to 110.

By "solvothermal treatment" is in particular meant a process in a closed reaction vessel inducing a decomposition or a chemical reaction(s) between precursor(s) in the presence of a solvent at a temperature higher than the boiling temperature of this solvent. The pressure can be autogeneous or imposed, in particular autogeneous.

By "compound insoluble in a solvent" is in particular meant a compound for which the solubility in said solvent, notably at a temperature of 25° C., is equal to or less than 1 g/L, more particularly equal to or less than 0.1 g/L.

EXAMPLES

Example 1: Extraction of Lithium and Other Metals According to the Invention from Lithium-Ion Battery Cathode Material The extraction of lithium and other metals according to the invention from lithium-ion battery cathode material is for instance performed as follows:

Step 1:

This step is carried out in a solvothermal vessel, for example a steel or titanium vessel, in the presence of ethylene glycol or diethylene glycol and sodium carbonate and/or potassium carbonate.

After dissolving the carbonate in the solvent, lithium-ion battery cathode material (in powder form) is added. The materials tested were as follows: $LiCoO_2$, $LiMn_2O_4$, $LiNi_{0.33}Mn_{0.33}Co_{0.33}O_2$ and $Li_3Fe_2(PO_4)_3$, and $LiNi_{0.8}Co_{0.15}Al_{0.05}O_2$. The vessel is then closed and introduced into a heating chamber.

Examples of processing conditions for the different battery materials are summarized in Table 1. The pressure in the vessel was of 125 bar and can be higher than 125 bar, if achievable by the chosen vessel.

| Material | Treatment duration (h) | Treatment temperature (° C.) | Treated mass of material (g) | Mass of $Na_2CO_3$ (g) | Volume of ethylene glycol (mL) |
|---|---|---|---|---|---|
| $LiCoO_2$ | 5 | 225 | 0.5 | 0.541 | 30 |
| $LiNi_{0.33}Mn_{0.33}Co_{0.33}O_2$ | 72 | 225 | 0.5 | 0.552 | 30 |
| $LiMn_2O_4$ | 5 | 225 | 0.5 | 0.15 | 30 |
| $Li_3Fe_2(PO_4)_3$ | 18 | 225 | 0.5 | 0.19 | 30 |
| $LiNi_{0.8}Co_{0.15}Al_{0.05}O_2$ | 40 | 225 | 0.5 | 1.1 | 30 |

At the end of this stage, the vessel, after cooling to room temperature, contains a powder in suspension in a liquid. The liquid L1 and powder S1 are separated by centrifugation.

The recovered powder S1 then undergoes the following steps.

Step 2:

The powder S1 recovered in step 1 may be washed with ethanol: the powder is contacted with ethanol under ultrasound for a few minutes, then separated from the liquid by centrifugation. The purpose of this washing is to remove the residual sodium carbonate and ethylene glycol.

Step 3:

The powder obtained in step 1 or 2 is then washed with water, to obtain a solid S2 suspended in a water based liquid L2.

The solid S2 is recovered and then dried at 90° C. for a maximum of 2 hours.

In the case of $LiNi_{0.33}Mn_{0.33}Co_{0.33}O_2$, step 3 is slightly modified (Step 3'), as the washing is followed by magnetic separation: the powder dispersed in water is placed in the vicinity of a magnet, so as to separate the magnetic and non-magnetic fractions of the powder. In fact, only one of the phases formed during the treatment (the nickel-cobalt alloy) is magnetic and thus attracted by a magnet.

The supernatant liquid L2 then undergoes the next step.

Step 4:

The liquid L2 is dried under air at 90° C. for 3 to 5 hours.

The powders obtained after steps 3 and 4 can possibly be subjected to a last step.

Step 5:

Calcination under air for 2 hours at 500 or 800° C.

The composition of solid S2 and liquid L2 for some materials is presented in the following table 2.

| Material | Powder S2 | Supernatant L2 dried (s)/ calcinated (c) |
|---|---|---|
| $LiCoO_2$ | Co | (s) $Li_2CO_3$ |
| $LiNi_{0.33}Mn_{0.33}Co_{0.33}O_2$ | Magnetic: Ni/Co alloy<br>Non magnetic: $MnCO_3$ | (s) $Li_2CO_3$ |
| $LiMn_2O_4$ | $MnCO_3/Mn_3O_4$ then $Mn_2O_3$ after heating at 800° C. | (c) $Li_2CO_3$ |

The extraction yields for some materials is presented in the following table 3.

| Material | Li Content of L1 | Li content of L2 | Li content of L1 + L2 | Co content of S2 | Ni content of S2 | Mn content of S2 |
|---|---|---|---|---|---|---|
| $LiCoO_2$ | 18.8% of initial Li | 63.5% of initial Li | 82.3% of initial Li | 78.8% of initial Co | — | — |
| $LiNi_{0.33}Mn_{0.33}Co_{0.33}O_2$ | 73.8% of initial Li | 25.67% of initial Li | 99.47% of initial Li | 75.2% of initial Co | 76.5% of initial Ni | 48.1% of initial Mn |
| $LiMn_2O_4$ | 34.7% of initial Li | 65% of initial Li | 99.7% of initial Li | — | — | 93.8% of initial Mn |

It has been found that the yield of extraction of the metals recovered in the form of a powder (Co, Ni, Mn) can be improved by reusing the polyol solvent and the aqueous solution (i.e. by using the L1 and/or L2 liquids of previous processes).

Example 2: Extraction of Lithium from Lithium Ores

It has been shown that a process that is analogous to the one mentioned in example 1 is successfully performed on lithium ores such as spodumene.

For example, 1.0 g of β $LiAlSi_2O_6$ was successfully treated with 0.85 g of $Na_2CO_3$ in 30 ml of EG at 225° C. for 12 hours.

The EG solvent can be reused as described above.

Example 3: Extraction of Lithium and Other Metals with Recycling of the Polyol Solvent The ethylene glycol solvent (EG) can be reused without filtration at least 4 times. Reused EG retains its reducing properties.

On $LiMn_2O_4$ electrode powder Two runs as defined below were performed in the same treatment conditions using the same solvent.

0.5 g of $LiMn_2O_4$ was treated with 0.2 g of $K_2CO_3$ in 30 ml of EG at 225° C. for 5 hours.

The obtained SP1 composition was analyzed by Inductively Coupled Plasma (ICP). Results are presented in following table 4.

| | Comp. of SP1 | $V_{EG}$ | Li in solution (L1) | Li in S1 ($Li_2CO_3$) | Mn in S1 ($MnCO_3/Mn_3O_4$) |
|---|---|---|---|---|---|
| 1st use of the EG | EG/Li in Sol./ $Li_2CO_3/MnCO_3/Mn_3O_4$ | ~93% of the initial volume | undetectable (because too diluted in view of the large volume of solvent dosed) | 56.96% of initial Li | 94.61% of initial Mn |
| 2nd use of the EG | EG/Li in Sol./ $Li_2CO_3/MnCO_3/Mn_3O_4$ | ~93% of the initial volume | 32.6% of initial Li | 112.99% of initial Li | 107.07% of initial Mn |

The yield in Mn can generally be increased for example by increasing the centrifugation speed. From the $2^{nd}$ use of the solvent, the yield of recovered Li and/or Mn in S1 powders can be close to or above 100%, as residual material (Mn oxide particles) or dissolved material (Li carbonate) is being recovered in the EG originating from the first runs.

On $LiMn_2O_4$ Electrode Powder (Doubled Quantity)

Three runs as defined below were performed in the same treatment conditions using the same solvent. 1.0 g of $LiMn_2O_4$ was treated with 0.2 g of $K_2CO_3$ in 30 ml of EG at 225° C. for 8 hours.

The obtained SP1 composition was analyzed by Inductively Coupled Plasma (ICP). Results are presented in following table 5.

| | Comp. of SP1 | $V_{EG}$ | Li in solution (L1) | Li in S1 ($Li_2CO_3$) | Mn in S1 ($MnCO_3$/ $Mn_3O_4$) |
|---|---|---|---|---|---|
| $1^{st}$ use of the EG | EG/Li in Sol./ $Li_2CO_3$/$MnCO_3$/ $Mn_3O_4$ | ~93% of the initial volume | — | 73.53% of initial Li | 87.15% of initial Mn |
| $2^{nd}$ use of the EG | EG/Li in Sol./ $Li_2CO_3$/$MnCO_3$/ $Mn_3O_4$ | ~93% of the initial volume | — | 99.77% of initial Li | 90.68% of initial Mn |
| $3^{rd}$ use of the EG | EG/Li in Sol./ $Li_2CO_3$/$MnCO_3$/ $Mn_3O_4$ | ~93% of the initial volume | 57.69% of initial Li | 118.34% of initial Li | 101.05% of initial Mn |

The yield in Mn can generally be increased by for example increasing the centrifugation speed.

From the $2^{nd}$ use of the solvent, the yield of recovered Li and/or Mn in S1 powders can be close to or above 100%, as residual material (Mn oxide particles) or dissolved material (Li carbonate) is being recovered in the EG originating from the first runs.

Example 4: Extraction of Lithium and Other Metals from a Mixture of Electrode Powders ($LiCoO_2$; $LiMn_2O_4$; $LiNi_{0.33}Mn_{0.33}Co_{0.33}O_2$; $LiNi_{0.8}Co_{0.15}Al_{0.05}O_2$)

Four runs as defined below were performed in the same treatment conditions using the same solvent. 1.0 g of a mixture containing 0.25 g of $LiCoO_2$, 0.25 g of NMC, 0.25 g of NCA and 0.25 g of $LiMn_2O_4$ was treated with 1.52 g of $K_2CO_3$ in 60 ml of EG at 225° C. for 45 hours.

The obtained SP1 composition was analyzed by Inductively Coupled Plasma (ICP). Results are presented in following table 6.

| Electrode | Comp. of SP1 | $V_{EG}$ | Li in solution (L1) | Li in S1 ($Li_2CO_3$) | Co in S1 ($CoO/Co_{\alpha,\beta}$/ Ni—Co) | Ni in S1 (Ni—Co) | Mn in S1 ($MnCO_3$/ $Mn_3O_4$) |
|---|---|---|---|---|---|---|---|
| $1^{st}$ use of the EG | EG/Li in Sol./ $Li_2CO_3$/Ni—Co/ $MnCO_3$/Al/ $Li_{0.125}(NiCo)_{0.875}O$ | ~93% of the initial volume | traces | 39.44% of initial Li | 73.5% of initial Co | 47.01% of initial Ni | 89.33% of initial Mn |
| $2^{nd}$ use of the EG | EG/Li in Sol./ $Li_2CO_3$/Ni—Co/ $MnCO_3$/Al/ $Li_{0.125}(NiCo)_{0.875}O$ | ~93% of the initial volume | 94.32% of initial Li | 60.86% of initial Li | 67.91% of initial Co | 40.25% of initial Ni | 73.7% of initial Mn |
| $3^{rd}$ use of the EG | EG/Li in Sol./ $Li_2CO_3$/Ni—Co/ $MnCO_3$/Al/ $Li_{0.125}(NiCo)_{0.875}O$ | ~93% of the initial volume | | 86.05% of initial Li | | | |
| $4^{th}$ use of the EG | EG/Li in Sol./ $Li_2CO_3$/Ni—Co/ $MnCO_3$/Al/ $Li_{0.125}(NiCo)_{0.875}O$ | ~93% of the initial volume | 99.07% of initial Li | 89.45% of initial Li | 113.02% of initial Co | 152.20% of initial Ni | 66.04% of initial Mn |

Three powders could be obtained:

from S2, a powder attracted by a magnet, essentially containing the Ni—Co alloy;

also from S2, a free powder, containing essentially $MnCO_3$;

from L2, a powder obtained after drying of the water supernatant, containing pure $Li_2CO_3$.

Example 4 shows that even when mixing electrode powders, separation of the desired elements is still achieved.

The process of the invention thus makes it possible to recycle a mixture of battery powders without going through a sorting stage.

Furthermore, by reusing the same solvent several times, the purity of the recovered compounds is preserved.

Example 5: On a Whole Battery

After dismantling a MI battery, a powder from the electrodes (mixture of anode and cathode) was recovered.

The recovered powder was sieved using three different mesh sieves:

630 μm, to obtain a powder hereinafter referred to as 'MI T630'.

200 μm, to obtain a powder hereinafter referred to as 'MI T200'.

40 μm, to obtain a powder hereinafter referred to as 'MI T40'.

The MI T200 powder was analyzed by Inductively Coupled Plasma (ICP). Results are presented in following table 7.

| | MI T200 sieved before treatment |
|---|---|
| Al | 0.69% |
| Co | 56.83% |
| Li | 5.10% |

1.0 g of the MI T200 powder was treated with 0.5 g of $K_2CO_3$ in 30 ml of EG at 225° C. for 8 hours.

The obtained SP1 composition was analyzed by Inductively Coupled Plasma (ICP). Results are presented in following table 7.

| | Comp. Of SP1 | $V_{EG}$ | Li in solution (L1) | Li in S1 ($Li_2CO_3$) | Co in S1 (CoO/ $Co_{\alpha,\beta}$) | Al in S1 |
|---|---|---|---|---|---|---|
| MI T200 powder | EG/Li in Sol./ $Li_2CO_3$/Co/ CoO/K/Al/P | ~93% of the initial volume | 32.64% of initial Li | 58.75% of initial LI | 90.66% of initial Co | 30.53% of initial Al |

Lithium carbonate can be separated from Al by sieving.

Lithium carbonate can also be re-dissolve in water, filtered and the solution dried to separate from the aluminium. This step can replace centrifugation.

The powder attracted (from the S2 solid) by a magnet essentially contains CoO, alpha- and beta-Co. 1.0 g of the MI T40 powder was treated with 0.5 g of $K_2CO_3$ in 30 ml of EG (already used one time) at 225° C. for 16 hours.

From the obtained SP1 and then the S2 solid, the powder attracted by a magnet essentially contains alpha- and beta-Co, and the free fraction could be sieved to recover the graphite alone.

Lithium carbonate can be separated from Al by sieving.

Lithium carbonate can also be re-dissolve in water, filtered and the solution dried to separate from the aluminium. This step can replace centrifugation.

Most of the graphite remained in the 200 micron and mostly in the 630 micron sieves, and is in any case not affected by the recycling process.

The invention claimed is:

1. A process of extraction of lithium from a material comprising lithium and at least another metal, said process comprising the following steps:

a) contacting said material with a polyol solvent and at least one metal carbonate to obtain a reaction mixture;

b) performing a solvothermal treatment of the reaction mixture obtained in step a) to obtain a solvothermally treated composition SP1;

c) separating a liquid L1 containing lithium carbonate and a solid S1 forming the solvothermally treated composition SP1 obtained in step b); and d) optionally, isolating solid lithium carbonate from the liquid L1.

2. The process according to claim 1, comprising, after step c) and optional step d), the following steps:

e) contacting the solid S1 with water to obtain a composition SP2;

f) separating a liquid L2 containing lithium carbonate and a solid S2 forming the composition SP2 obtained in step e); and g) optionally, isolating solid lithium carbonate from the liquid L2.

3. The process according to claim 2, wherein the solid S1 obtained in step c) is, prior to step e), washed with a solvent in which lithium carbonate is not soluble.

4. The process according to claim 2, wherein the at least another metal is at least a magnetic metal, or at least a magnetic metal and at least a non magnetic metal, and wherein the separating step f) is preceded by a magnetic separating step f1), to isolate the at least a magnetic metal from the composition SP2.

5. The process according to claim 2, of lithium-ion battery cathode recycling, wherein step a) is preceded by a step of recovery of a lithium-ion battery cathode material from a lithium-ion battery, and wherein step g) is performed and is optionally followed by a step of use of lithium, the at least another metal, or lithium and the at least another metal in a new process or device.

6. The process of claim 2, wherein step g) is performed.

7. The process according to claim 1, wherein the at least another metal is chosen from transition metals and post-transition metals.

8. The process according to claim 1, wherein the material is a lithium-ion battery cathode material or a lithium ore.

9. The process according to claim 1, wherein the polyol solvent is chosen from the group consisting of ethylene glycol, diethylene glycol, triethylene glycol, tetraethylene glycol, propylene diol, liquid polyethylene glycols, butylene glycol, and glycerol.

10. The process according to claim 1, further including steps of repeating steps a)-c) and optional step d) on a fresh batch of said material, wherein the polyol solvent used in the repeated step a) is the liquid L1 of the previous step c).

11. The process according to claim 1, wherein the solvothermal treatment of step b) is performed at a temperature over the boiling point of the polyol solvent and under 500° C.

12. The process according to claim 1, wherein the solvothermal treatment of step b) is performed at a pressure above atmospheric pressure.

13. The process according to claim 1, wherein the solvothermal treatment of step b) is performed for 1 hour to 1 week.

14. The process according to claim 1, of lithium-ion battery cathode recycling, wherein step a) is preceded by a step of recovery of a lithium-ion battery cathode material from a lithium-ion battery, and wherein step d) is performed and is optionally followed by a step of use of lithium, the at least another metal, or lithium and the at least another metal in a new process or device.

15. The process of claim 14, wherein the step of use of lithium, the at least another metal, or lithium and the at least another metal in a new process or device is performed.

16. The process of claim 1, wherein step d) is performed.

17. A process of extraction of lithium from a material comprising lithium and at least another metal, said process comprising the following steps:

a) contacting said material with a polyol solvent and a carbonate to obtain a reaction mixture;

b) performing a solvothermal treatment of the reaction mixture obtained in step a) to obtain a solvothermally treated composition SP1;

c) separating a liquid L1 containing lithium carbonate and a solid S1 forming the solvothermally treated composition SP1 obtained in step b);

d) optionally, isolating solid lithium carbonate from the liquid L1;

e) washing the solid S1 with a solvent in which lithium carbonate is not soluble;

f) contacting the solid S1 with water to obtain a composition SP2;

g) separating a liquid L2 containing lithium carbonate and a solid S2 forming the composition SP2 obtained in step f); and h) optionally, isolating solid lithium carbonate from the liquid L2.

* * * * *